US010746108B2

(12) United States Patent
Rumpsa

(10) Patent No.: US 10,746,108 B2
(45) Date of Patent: Aug. 18, 2020

(54) METHODS AND SYSTEM FOR REACTIVATING ENGINE CYLINDERS

(71) Applicant: Ford Global Technologies, LLC, Dearborn, MI (US)

(72) Inventor: Todd Anthony Rumpsa, Saline, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1146 days.

(21) Appl. No.: 14/518,678

(22) Filed: Oct. 20, 2014

(65) Prior Publication Data

US 2016/0108825 A1 Apr. 21, 2016

(51) Int. Cl.

| | |
|---|---|
| ***F02M 63/02*** | (2006.01) |
| ***F02D 17/02*** | (2006.01) |
| ***F02D 41/34*** | (2006.01) |
| ***F02D 41/00*** | (2006.01) |
| *F02D 41/12* | (2006.01) |

(52) U.S. Cl.

CPC ..... *F02D 17/02* (2013.01); *F02D 41/0087* (2013.01); *F02D 41/345* (2013.01); *F02D 41/126* (2013.01); *F02D 2200/021* (2013.01)

(58) Field of Classification Search

CPC ..... F02D 41/0087; F02D 41/123; F02D 2041/0012

USPC ..... 123/332

See application file for complete search history.

(56) References Cited

U.S. PATENT DOCUMENTS

| | | | | |
|---|---|---|---|---|
| 5,839,409 | A * | 11/1998 | Denz | F02D 41/0087 123/326 |
| 7,234,440 | B2 | 6/2007 | Hilditch | |
| 7,900,601 | B2 | 3/2011 | Gwidt et al. | |
| 2003/0172900 | A1* | 9/2003 | Boyer | F01L 1/34 123/198 F |
| 2004/0055569 | A1* | 3/2004 | Matthews | F01L 13/0005 123/399 |
| 2011/0040471 | A1* | 2/2011 | Krupadanam | F02D 41/0087 701/101 |
| 2011/0162608 | A1* | 7/2011 | Riegger | F01L 13/0005 123/90.32 |
| 2013/0092126 | A1* | 4/2013 | Leone | F02D 9/1055 123/399 |
| 2013/0144508 | A1* | 6/2013 | Dentici | F02D 45/00 701/103 |

(Continued)

OTHER PUBLICATIONS

Glugla, Chris P. et al., "Variable Displacement Engine Control System and Method," U.S. Appl. No. 13/968,240, filed Aug. 15, 2013, 65 pages.

(Continued)

*Primary Examiner* — Long T Tran
*Assistant Examiner* — James J Kim
(74) *Attorney, Agent, or Firm* — Geoffrey Brumbaugh McCoy Russell LLP

(57) ABSTRACT

Systems and methods for reactivating cylinders of an engine that have been temporarily deactivated to conserve fuel are presented. The systems and methods adjust fuel injection quantity and timing of direct fuel injectors to reduce particulate emissions that may form in cylinders that are being reactivated due to reduced piston and combustion chamber temperatures that may occur in newly reactivated cylinders.

23 Claims, 8 Drawing Sheets

(56) References Cited

U.S. PATENT DOCUMENTS

| | | | | |
|---|---|---|---|---|
| 2013/0199496 | A1* | 8/2013 | Gibson | F02D 41/042 123/403 |
| 2014/0069374 | A1* | 3/2014 | Matthews | F02D 41/0087 123/350 |
| 2015/0051816 | A1* | 2/2015 | Glugla | F02D 41/0055 701/108 |

OTHER PUBLICATIONS

Glugla, Chris P. et al., "Variable Displacement Engine Control System and Method," U.S. Appl. No. 13/968,252, filed Aug. 15, 2013, 67 pages.

Vanderwege, Brad A., "Method and System for Particulate Matter Control," U.S. Appl. No. 14/521,314, filed Oct. 22, 2014, 60 pages.

* cited by examiner

METHODS AND SYSTEM FOR REACTIVATING ENGINE CYLINDERS

FIELD

The present description relates to methods and a system for reactivating cylinders of an engine that have been temporarily deactivated while other engine cylinders continue to combust air and fuel. The methods may be particularly useful in engines that include direct fuel injectors.

BACKGROUND AND SUMMARY

Direct fuel injection has been applied to gasoline engines to improve engine efficiency and performance. Further, injecting gasoline or a gasoline and alcohol mixture directly into an engine cylinder reduces transient fueling errors that may be observed on port fuel injected engines. However, direct fuel injected engines may increase particulate emissions of a gasoline engine. The particulate emissions may result from incomplete vaporization or poor mixing of the injected fuel. Incomplete vaporization is particularly likely to occur if the injected fuel impinges on a combustion surface which is not sufficiently hot to support fuel evaporation prior to combustion. This can result in fuel puddles in the combustion chamber, which produce high particulate emissions when burned. This change in fuel vaporization and puddling behavior as a function of combustion system temperature requires careful scheduling of fuel injection events to optimize engine behavior.

The inventor herein has recognized the above-mentioned disadvantages of direct fuel injected engines and have developed a method, comprising: operating a first cylinder of an engine while a second cylinder of the engine is deactivated; reactivating the second cylinder in an engine cycle where the first cylinder is supplied a first actual total number of fuel injections and injection timing; and supplying the second cylinder a second actual total number of fuel injections and injection timing different than the first actual total number of fuel injections and injection timing during the engine cycle.

By supplying a previously deactivated cylinder with a different number and timing of fuel injections than a cylinder that has been active while the cylinder was deactivated, it may be possible to reduce the fuel impingement on cold combustion surfaces of the newly reactivated cylinder and provide the technical result of reducing particulate formation in the newly reactivated cylinder while maintaining emissions and efficiency in the cylinder that remained active. For example, the number of fuel injections provided to the previously deactivated cylinder during an engine cycle may be greater than a number of fuel injections provided to the cylinder that remained active. Additionally, the timing of the fuel injection(s) provided to the newly reactivated cylinder may be later in the combustion cycle than for the cylinder that remained active. The additional fuel injections and/or later injection timing may help to reduce fuel impingement and improve fuel vaporization and mixing in the previously deactivated cylinder. One the other hand, the number of fuel injections provided to the cylinder that remained active may be fewer, and the timing of the fuel injections may be earlier, than the number and timing of fuel injections supplied to the previously deactivated cylinder so that CO emissions an fuel consumption of the cylinder that remained activated may be maintained at an optimum level for the hot combustion chamber.

The present description may provide several advantages. In particular, the approach may reduce engine particulate emissions. Additionally, the approach may improve vehicle fuel economy by allowing active cylinders to continue to operate with the most efficient fuel injection settings. Further, the approach may provide more consistent vehicle emissions after reactivating engine cylinders.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
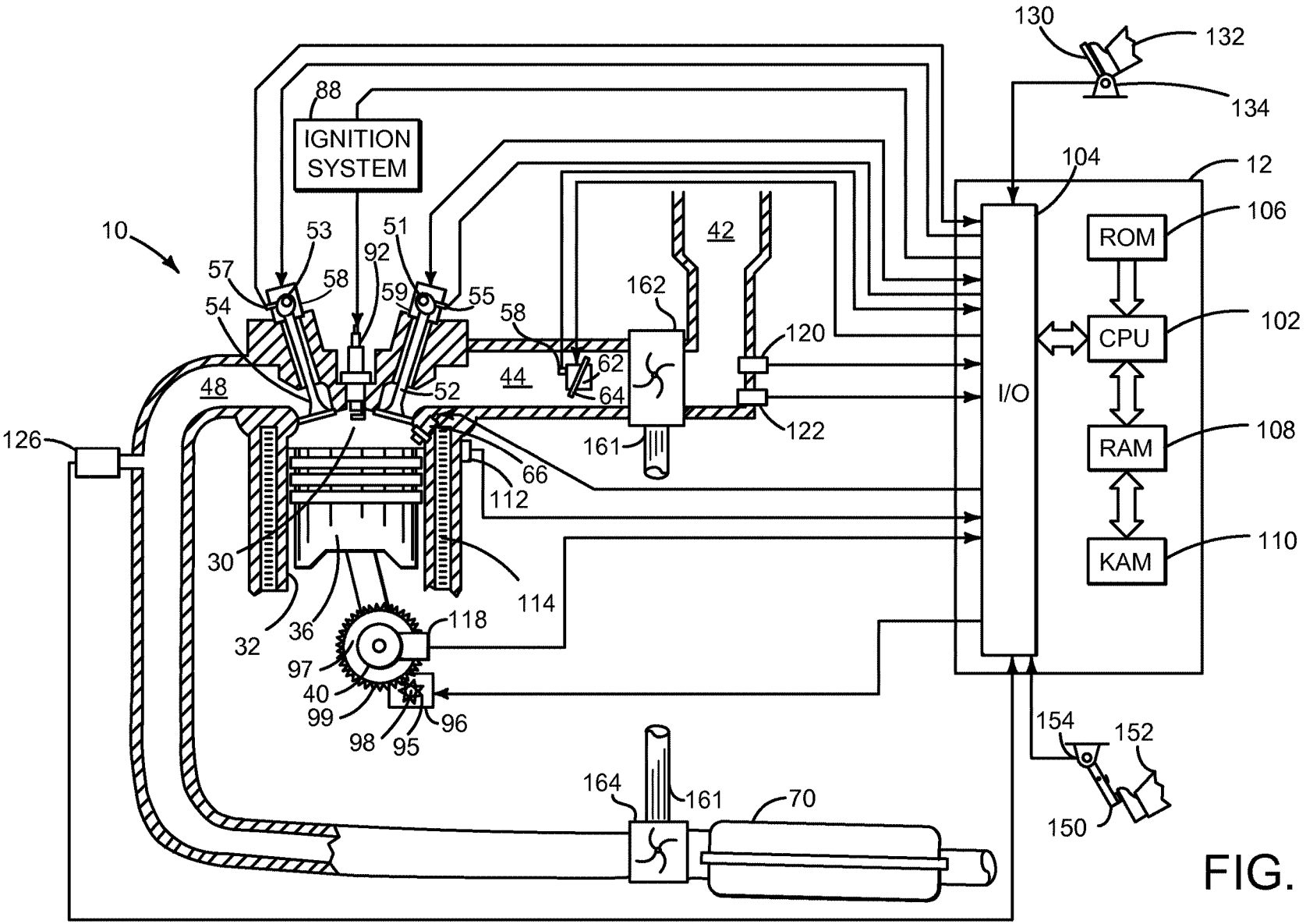
FIG. 1 is a schematic diagram of an engine.
Figure 2C:
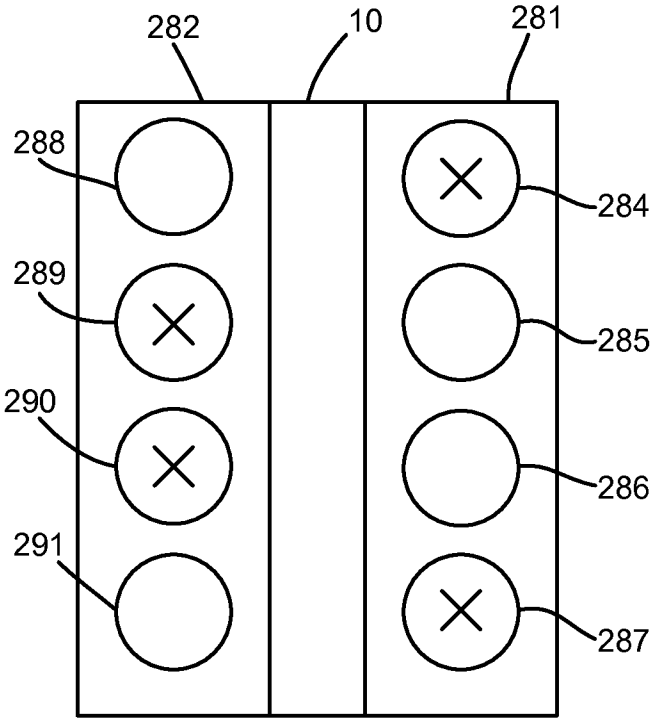
FIGS. 2A-2C show example engines with deactivated cylinders.
Figure 2B:
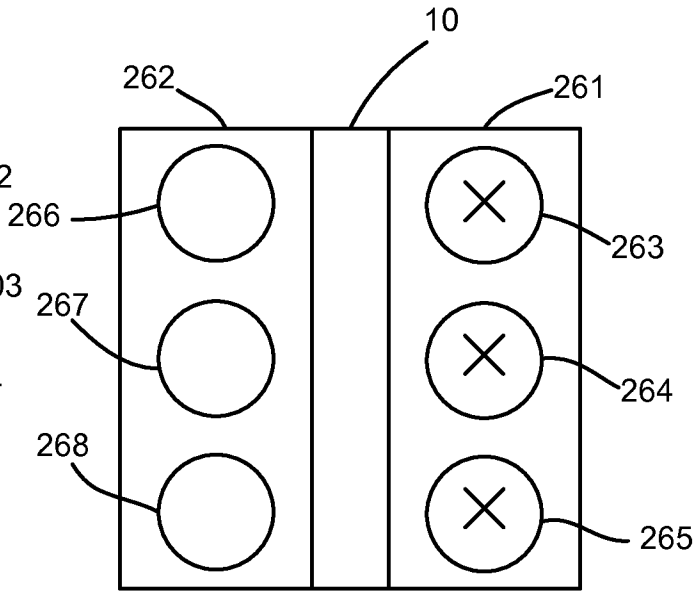
Figure 2A:
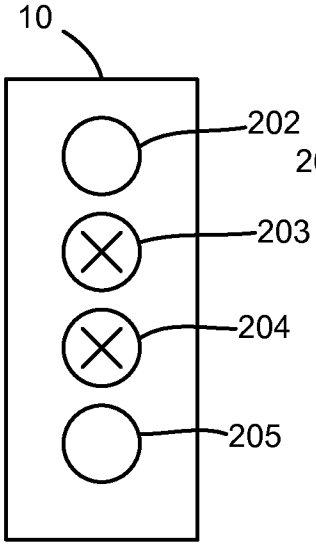
Figure 3:
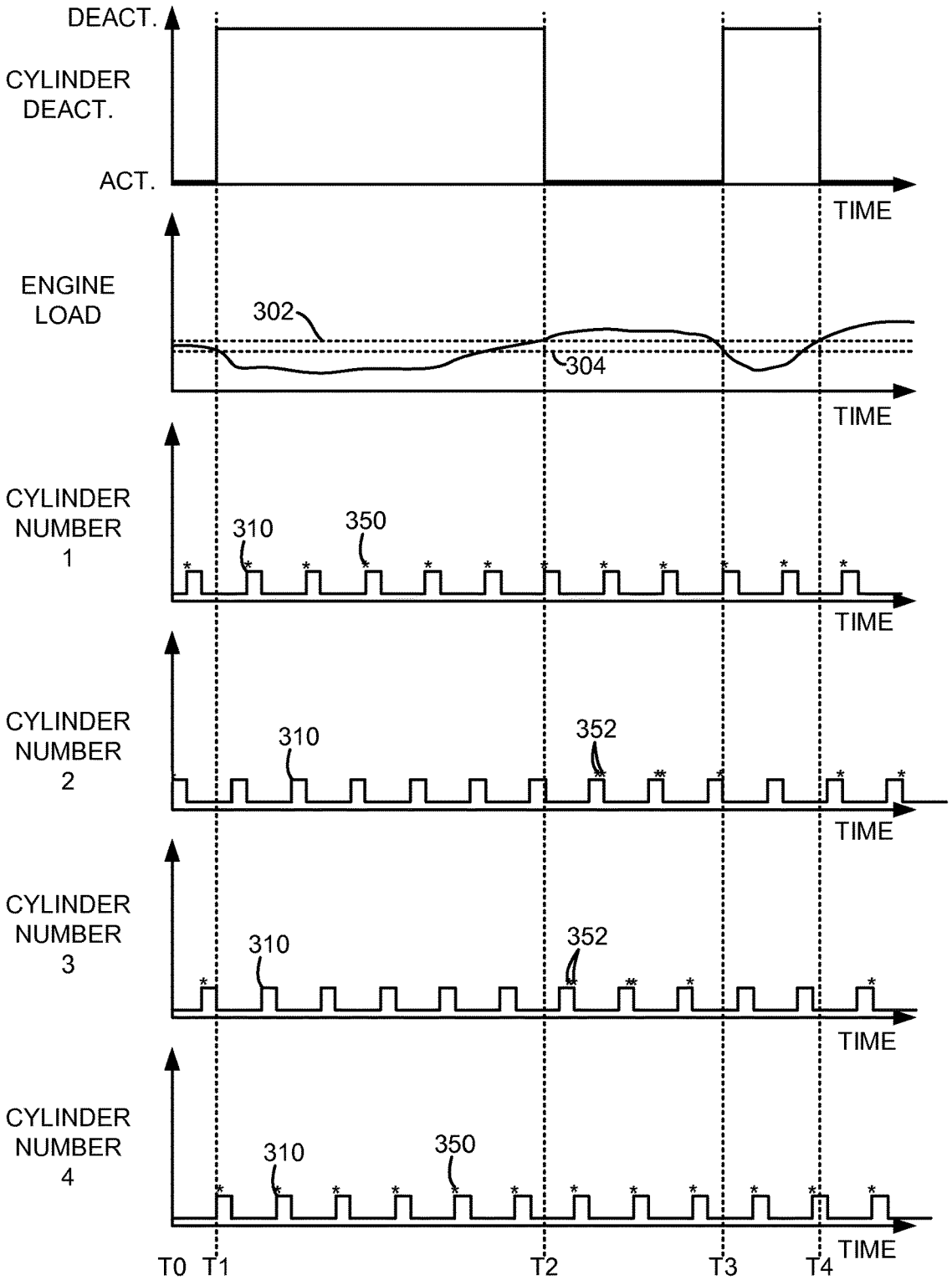
FIG. 3 shows an example cylinder deactivation and reactivation sequence.
Figure 4A:
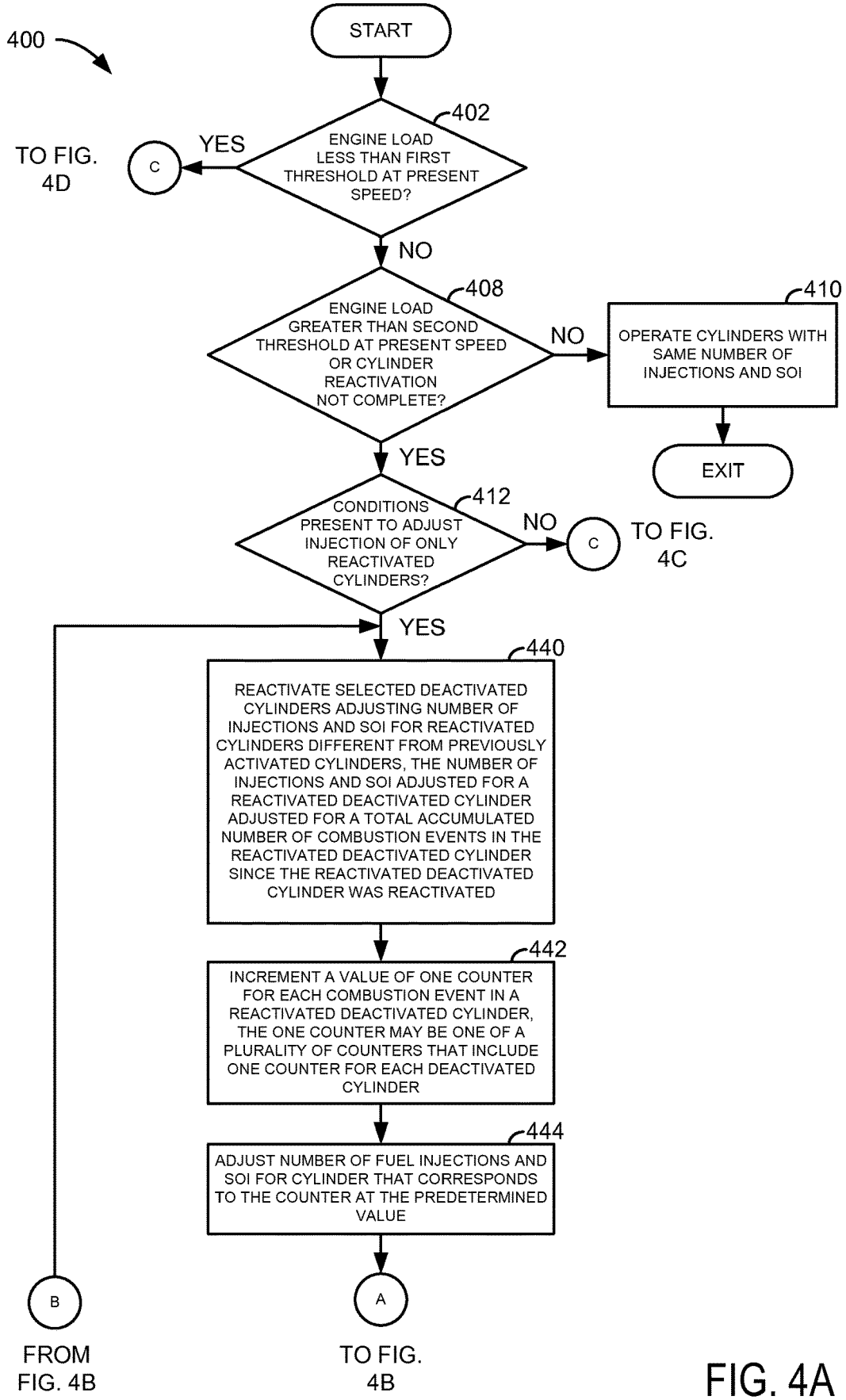
FIGS. 4A-4D shows an example method for operating an engine.
Figure 4B:
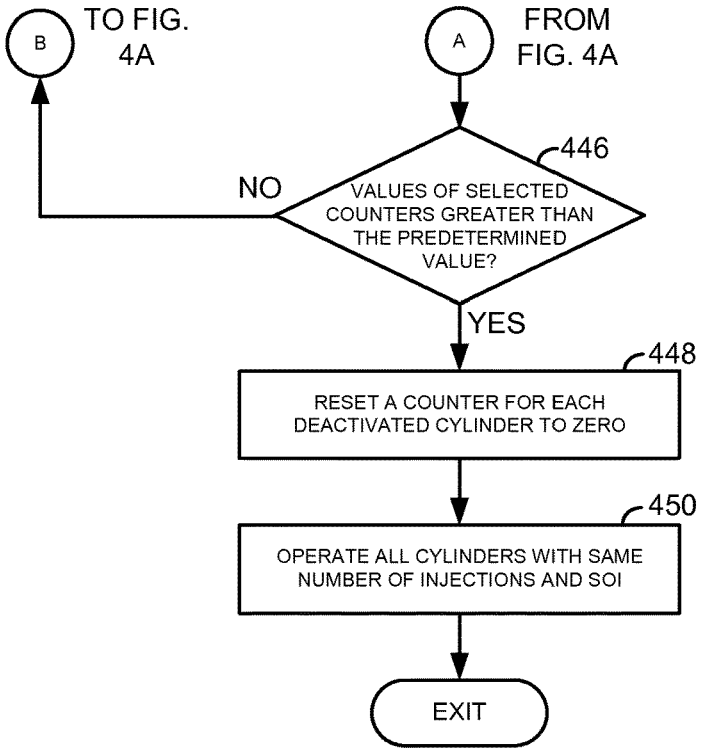
Figure 4C:
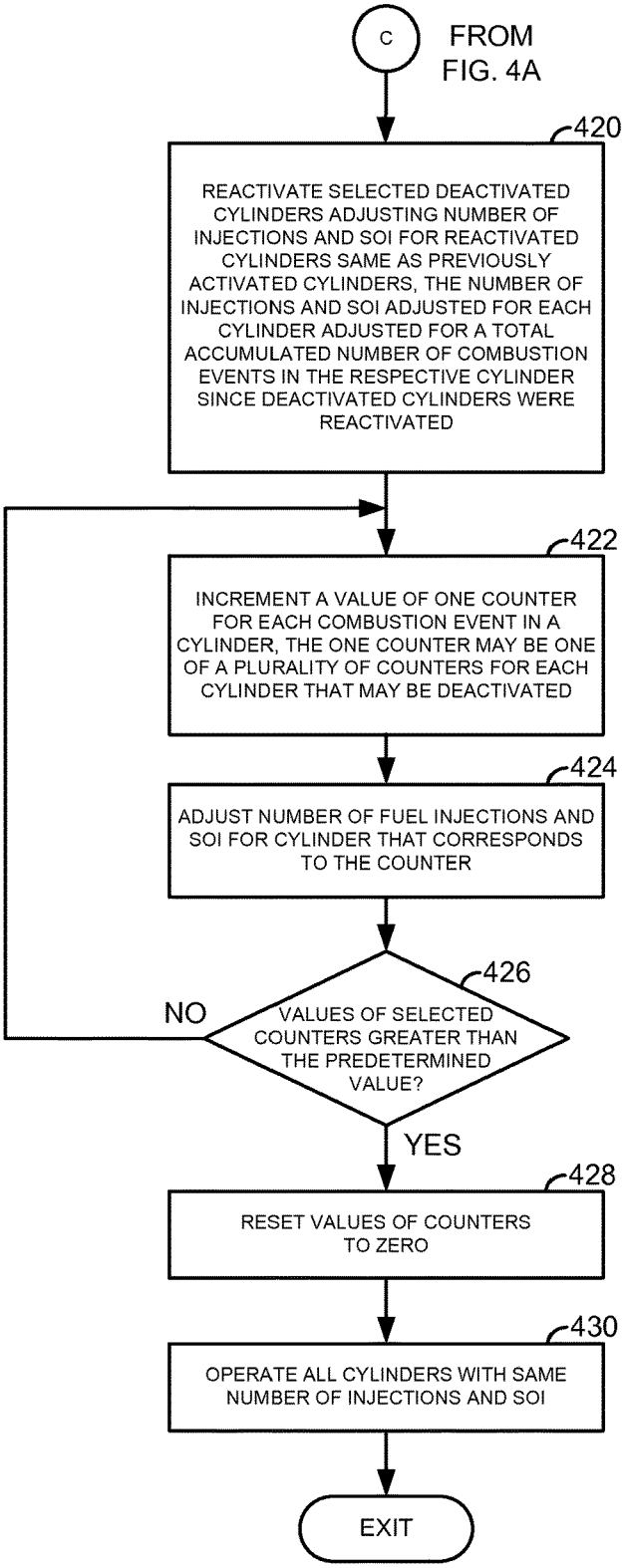
Figure 4D:
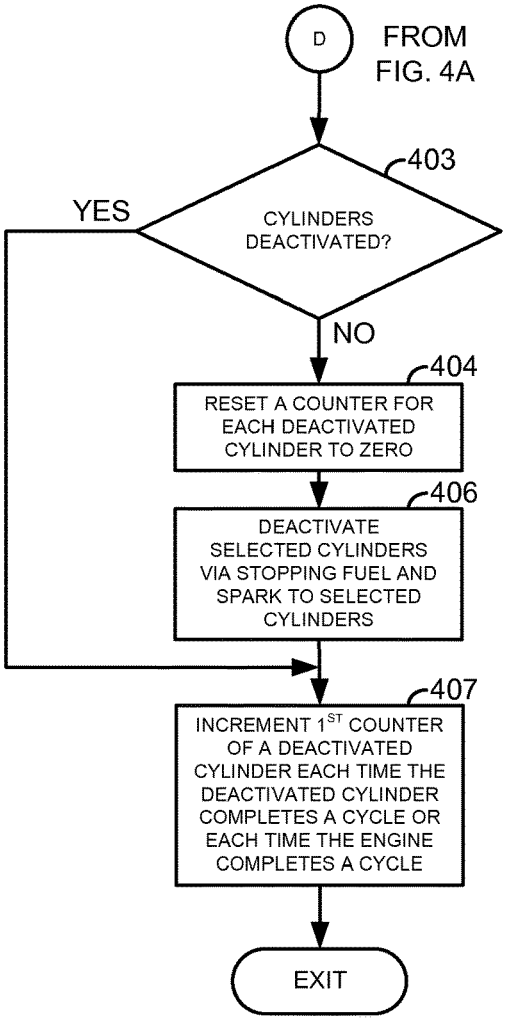

The present description is related to reactivating engine cylinders after the cylinders have been deactivated while the engine continues to rotate. An engine cylinder as is shown in FIG. 1 may be included in a vehicle. The engine cylinder may be part of a multi-cylinder engine as is shown in FIGS. 2A-2C. The engine may be operated as is shown in the sequence of FIG. 3 to improve engine efficiency and reduce engine emissions. The method of FIG. 4A-4D may be part of the engine system shown in FIG. 1, and the method of FIG. 4A-4D may provide the operating sequence shown in FIG. 3.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Flywheel 97 and ring gear 99 are coupled to crankshaft 40. Starter 96 (e.g., low voltage (operated with less than 30 volts) electric machine) includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake valve 52 may be selectively activated and deactivated by valve activation device 59. Exhaust valve 54 may be selectively activated and deactivated by valve activation device 58.

Fuel injector 66 is shown positioned to inject fuel directly into cylinder 30, which is known to those skilled in the art as direct injection. Fuel injector 66 delivers liquid fuel in proportion to the pulse width from controller 12. Fuel is delivered to fuel injector 66 by a fuel system (not shown) including a fuel tank, fuel pump, and fuel rail (not shown).

In addition, intake manifold 44 is shown communicating with turbocharger compressor 162 and air intake 42. Shaft 161 mechanically couples turbocharger turbine 164 to turbocharger compressor 162. Optional electronic throttle 62 adjusts a position of throttle plate 64 to control air flow from compressor 162 to intake manifold 44. In one example, a high pressure, dual stage, fuel system may be used to generate higher fuel pressures. In some examples, throttle 62 and throttle plate 64 may be positioned between intake valve 52 and intake manifold 44 such that throttle 62 is a port throttle.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a position sensor 154 coupled to brake pedal 150 for sensing force applied by foot 152, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle as shown in FIG. 2. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

FIG. 2A is a schematic illustration of an example four cylinder engine 10 that may include combustion chamber 30 and its accompanying cylinder. Four cylinder engine 10 is a four stroke engine that completes an engine cycle and cylinder cycle in two crankshaft revolutions. The four cylinder engine may have a firing order (e.g., order of combustion) of 1-3-4-2 where the numbers represent respective cylinder numbers. In this example, cylinder number one is labeled 202, cylinder number two is labeled 203, cylinder number three is labeled 204, and cylinder number four is labeled 205. Cylinders two and three may be selectively deactivated (e.g. closing intake and exhaust valves of the deactivated cylinder while stopping fuel flow and spark to the deactivated cylinder) as indicated by the X's while the engine continues to rotate. Operating two cylinders at a higher load than would be present if all four cylinders where producing the same level of torque output as only two cylinders may increase efficiency of the two active cylinders. The engine combusts evenly (e.g., a same number of crankshaft degrees between combustion events) when cylinders two and three are deactivated because the engine's firing order is 1-3-4-2.

Cylinders two and three may be selectively deactivated and reactivated based on engine speed and load. For example, if the driver supplies a higher demand torque via an accelerator pedal, the engine may be operated with four active (e.g., combusting) cylinders. However, if the driver demand torque is low, the engine may operate with only two active cylinders. Thus, four cylinder engine 10 may operate selectively as a two or four cylinder engine.

FIG. 2B is a schematic illustration of an example six cylinder engine 10 that may include combustion chamber 30 and its accompanying cylinder. Six cylinder engine 10 is a four stroke engine that completes an engine cycle and cylinder cycle in two crankshaft revolutions. In this example, cylinder number one is labeled 268, cylinder number two is labeled 267, cylinder number three is labeled 266, cylinder number four is labeled 265, cylinder number five is labeled 264, and cylinder number six is labeled 263. Cylinders one, two, and three are part of cylinder bank 262. Cylinders four, five, and six are part of cylinder bank 261.

Cylinders four, five, and six may be selectively deactivated (e.g. closing intake and exhaust valves of the deactivated cylinder while stopping fuel flow and spark to the deactivated cylinder) as indicated by the X's while the engine continues to rotate. The engine combusts evenly (e.g., a same number of crankshaft degrees between combustion events) when cylinders four, five, and six are deactivated because the engine's firing order is 1-4-2-5-3-6. Cylinders four, five, and six may be selectively deactivated and reactivated based on engine speed and load. Thus, six cylinder engine 10 may operate selectively as a three or six cylinder engine.

FIG. 2C is a schematic illustration of an example eight cylinder engine 10 that may include combustion chamber 30 and its accompanying cylinder. Eight cylinder engine 10 is a four stroke engine that completes an engine cycle and cylinder cycle in two crankshaft revolutions. In this example, cylinder number one is labeled 291, cylinder number two is labeled 290, cylinder number three is labeled 289, cylinder number four is labeled 288, cylinder number five is labeled 287, cylinder number six is labeled 286, cylinder number seven is labeled 285, and cylinder number eight is labeled 284.

Cylinders two, three, five, and eight may be selectively deactivated (e.g. closing intake and exhaust valves of the deactivated cylinder for at least an entire engine cycle while stopping fuel flow and spark to the deactivated cylinder) as indicated by the X's while the engine continues to rotate. The engine combusts evenly (e.g., a same number of crankshaft degrees between combustion events) when cylinders two, three, five, and eight are deactivated because the engine's firing order is 1-8-4-3-6-5-7-2. Cylinders two, three, five, and eight be selectively deactivated and reactivated based on engine speed and load. Thus, eight cylinder engine 10 may operate selectively as a four or eight cylinder engine. Cylinders one, two, three, and four are part of cylinder bank 282. Cylinders five, six, seven, and eight are part of cylinder bank 281.

It should be noted that the four, six, and eight cylinder engines shown in FIGS. 2A-2C are exemplary only and are not intended to narrow the scope of disclosure. For example, engines having cylinders number differently and/or different firing orders are also anticipated. Further, engines having fewer or greater numbers of cylinders are also envisioned.

Referring now to FIG. 3, several cylinder deactivation sequences according to the method of FIG. 4 are shown. The sequences of FIG. 3 may be provided by the system of FIGS. 1 and 2 executing the method of FIG. 4. The cylinder deactivation sequence is for a four cylinder, four stroke engine. In this example, the engine is operated at a constant speed to simplify the sequence.

The first plot from the top of FIG. 3 is a plot of cylinder deactivation request versus time. One or more engine cylinders are requested to be deactivated by closing intake and exhaust valves for at least an entire engine cycle, stopping fuel flow to the one or more cylinders, and stopping spark supplied to the one or more cylinders when the trace is at a higher level. The engine cylinders are all requested to be activated when the trace is at a lower level near the X axis. The X axis represents time and time increases from the left side of FIG. 3 to the right side of FIG. 3. The Y axis represents state of the cylinder deactivation request and cylinders are requested to be deactivated when the trace is at a higher level near the Y axis arrow.

The second plot from the top of FIG. 3 is a plot of engine load versus time. The Y axis represents engine load and engine load increases in the direction of the Y axis arrow. The X axis represents time and time increases from the left side of FIG. 3 to the right side of FIG. 3. Horizontal line 304 represents a threshold engine load below which selected engine cylinders may be deactivated. Horizontal line 302 represents a threshold engine load above which all engine cylinders may be activated.

The third plot from the top of FIG. 3 is a plot of cylinder number one position and fuel injection versus time. The Y axis represents cylinder number one position and cylinder number one is on an intake stroke when the trace is at a higher level (e.g., closer to the Y axis arrow). Compression, expansion, and exhaust strokes for cylinder number one occur when the trace is at a lower level in the plot. The X axis represents time and time increases from the left side of FIG. 3 to the right side of FIG. 3. Asterisks 350 (*) are used to show start of injection (SOI) timing and a number of fuel injections during a cylinder cycle. A cylinder cycle begins at a rising edge 310, and SOI timing advances when an asterisk is shown closer, from the right side of the rising edge 310 (e.g., retarded timing since fuel injection for a cylinder cycle is after the cylinder cycle begins), to a rising edge 310. A cylinder cycle starts at a rising edge 310 (e.g., top-dead-center intake stroke of cylinder number one) of the trace and ends at a subsequent rising edge of the trace (e.g., top-dead-center intake stroke of cylinder number one) where a new cylinder cycle begins. An engine cycle is two crankshaft revolutions.

The fourth plot from the top of FIG. 3 is a plot of cylinder number two position and fuel injection versus time. The Y axis represents cylinder number two position and cylinder number two is on an intake stroke when the trace is at a higher level (e.g., closer to the Y axis arrow). Compression, expansion, and exhaust strokes for cylinder number two occur when the trace is at a lower level in the plot. The X axis represents time and time increases from the left side of FIG. 3 to the right side of FIG. 3. Asterisks 350 (*) are used to show start of injection timing and a number of fuel injections during a cylinder cycle. A cylinder cycle starts at a rising edge 310 (e.g., top-dead-center intake stroke of cylinder number two) of the trace and ends at a subsequent rising edge of the trace (e.g., top-dead-center intake stroke of cylinder number two) where a new cylinder cycle begins.

The fifth plot from the top of FIG. 3 is a plot of cylinder number three position and fuel injection versus time. The Y axis represents cylinder number three position and cylinder number three is on an intake stroke when the trace is at a higher level (e.g., closer to the Y axis arrow). Compression, expansion, and exhaust strokes for cylinder number three occur when the trace is at a lower level in the plot. The X axis represents time and time increases from the left side of FIG. 3 to the right side of FIG. 3. Asterisks 350 (*) are used to show start of injection timing and a number of fuel injections during a cylinder cycle. A cylinder cycle starts at a rising edge 310 (e.g., top-dead-center intake stroke of cylinder number three) of the trace and ends at a subsequent rising edge of the trace (e.g., top-dead-center intake stroke of cylinder number three) where a new cylinder cycle begins.

The sixth plot from the top of FIG. 3 is a plot of cylinder number four position and fuel injection versus time. The Y axis represents cylinder number four position and cylinder number four is on an intake stroke when the trace is at a higher level (e.g., closer to the Y axis arrow). Compression, expansion, and exhaust strokes for cylinder number four occur when the trace is at a lower level in the plot. The X axis represents time and time increases from the left side of FIG. 3 to the right side of FIG. 3. Asterisks 350 (*) are used to show start of injection timing and a number of fuel injections during a cylinder cycle. A cylinder cycle starts at a rising edge 310 (e.g., top-dead-center intake stroke of cylinder number four) of the trace and ends at a subsequent rising edge of the trace (e.g., top-dead-center intake stroke of cylinder number four) where a new cylinder cycle begins.

At time T0, all engine cylinders are active and engine load is greater than threshold 304. Fuel is injected to all engine cylinders during the intake stroke of the respective cylinders and one fuel injection pulse is provided as indicated by the single asterisk (*) above the pluses of each cylinder trace which represent intake strokes for the respective cylinders.

At time T1, the engine load is decreased in response to a driver releasing an accelerator pedal, thereby reducing driver demand torque. Fuel and spark (not shown) continue to be supplied to cylinder numbers one and four. Cylinders two and three are deactivated by closing intake and exhaust valves of cylinders two and three over entire cycles of cylinders two and three. Additionally, fuel injection and spark are not supplied to deactivated cylinders as indicated by the absence of asterisks above intake strokes of cylinders two and three.

Between time T1 and time T2, cylinder number two is deactivated for six cylinder cycles and cylinder number three is deactivated for five cylinder cycles as indicated by the cylinder traces that show intake strokes for the respective cylinders and the absence of asterisks.

At time T2, the cylinder deactivation trace is not asserted in response to engine load increasing above threshold 302. Consequently, cylinder number two and cylinder number three are reactivated in response to the increase in engine load. Cylinders number three are reactivated by allowing intake and exhaust valves to open and close over a cycle of the respective cylinders. Cylinder number two and cylinder number three are reactivated by supplying fuel to cylinders number two and three in two individual fuel pulses. Supplying fuel in two pulses in response to reactivating cylinder numbers two and three may reduce particulate emissions in cylinder numbers two and three. Cylinder number one continues to receive fuel in a single fuel pulse during a cycle of cylinder number one. Likewise, cylinder number four continues to receiver fuel in a single fuel pulse during a cycle of cylinder number four.

The number of fuel injections supplied to cylinder number two and the start of injection timing of cylinder number two for a first combustion event in cylinder number two since cylinder number two was deactivated may be based on the of the number of engine cycles or cylinder cycles cylinder number two was deactivated (six in this example), or the inferred piston or combustion chamber temperature. Likewise, the number of fuel injections supplied to cylinder number three and the start of injection timing of cylinder number three for a first combustion event in cylinder number three since cylinder number three was deactivated may be based on the of the number of engine cycles or cylinder cycles cylinder number three was deactivated (five in this example).

In this example, cylinder number two and cylinder number three are reactivated receiving two fuel injections per cylinder cycle and retarded start of injection timing with respect to start of injection timing for cylinder number one and four. In particular, delayed intake stroke injection allows the piston to be further away (and moving away with a high velocity) from the injector at time of injection and reduces fuel impingement & puddling on the colder pistons. Thus, the start of injection timings for cylinder numbers two and three are retarded from the start of injection timings for cylinder numbers one and four. Further, by increasing the number of injections provided to cylinders two and three during cycles of the cylinders, fuel penetration may be reduced, resulting in less impingement and puddling of fuel on the piston.

Between time T2 and T3, the number of fuel injections and start of fuel injection timing is adjusted for cylinder numbers two and three. The number of fuel injections and start of fuel injection timing for cylinders number one and four remains the same. In this example, the number of fuel injections supplied during a cylinder cycle to cylinder numbers two and three is decreased as an actual total number of combustion events in cylinder numbers two and three increases since the respective cylinders were reactivated. Further, the start of injection timing is advanced during a cylinder cycle to cylinder numbers two and three as the actual total number of combustion events in cylinder numbers two and three increases. Note that there are multiple inputs that may be used to for this adjustment, including the piston temperature or combustion chamber temperature (inferred or actual), time since enable, the number of combustion events in cylinder numbers two and three.

At time T3, the engine load is decreased in response to a driver releasing an accelerator pedal, thereby reducing driver demand torque. Fuel and spark (not shown) continue to be supplied to cylinder numbers one and four. Cylinders two and three are deactivated again by closing intake and exhaust valves of cylinders two and three over entire cycles of cylinders two and three. Additionally, fuel injection and spark are not supplied to deactivated cylinders as indicated by the absence of asterisks above intake strokes of cylinder numbers two and three.

Between time T3 and time T4, cylinder number two is deactivated for one cylinder cycle and cylinder number three is deactivated for two cylinder cycles as indicated by the cylinder traces that indicate intake stroke for the respective cylinders and the absence of asterisks.

At time T4, the cylinder deactivation trace is not asserted in response to engine load increasing above threshold 302. Therefore, cylinder number two and cylinder number three are reactivated in response to the increase in engine load. Cylinders number three are reactivated by allowing intake and exhaust valves to open and close over a cycle of the respective cylinders. Cylinder number two and cylinder number three are reactivated by supplying fuel to cylinders number two and three in one individual fuel pulse in each respective cylinder. Fuel may be supplied in fewer pulses when the cylinders have been deactivated for a fewer number of cylinder cycles, or when the piston/combustion chambers are at a similar temperature to the cylinders which were continuously firing. Additionally, start of fuel injection timing is retarding in cylinders two and three as compared to start of fuel injection timing in cylinders one and four. However, in other examples, start of fuel injection timing may be more or less retarded and the number of fuel injections supplied to the cylinders during a cylinder cycle may be greater than the number of fuel injections supplied to the cylinders that remained active. Cylinder number one continues to receive fuel in a single fuel pulse during a cycle of cylinder number one. Similarly, cylinder number four continues to receiver fuel in a single fuel pulse during a cycle of cylinder number four.

The number of fuel injections supplied to cylinder number two and the start of injection timing of cylinder number two for a first combustion event in cylinder number two since cylinder number two was deactivated may be based on the of the number of engine cycles or cylinder cycles cylinder number two was deactivated (one in this example), or based on the temperature (inferred or real) of the piston or combustion chamber. Likewise, the number of fuel injections supplied to cylinder number three and the start of injection timing of cylinder number three for a first combustion event in cylinder number three since cylinder number three was deactivated may be based on the of the number of engine cycles or cylinder cycles cylinder number three was deactivated (two in this example), or based on the temperature (inferred or real) of the piston or combustion chamber.

In this example, cylinder number two and cylinder number three are reactivated receiving one fuel injections per cylinder cycle and retarded start of injection timing with respect to start of injection timing for cylinder number one and four. Specifically, injections for cylinder numbers two and three occur during the later portion of their respective intake strokes (e.g., approaching BDC intake stroke), while injections for cylinders number one and four occur earlier (e.g., closer to TDC their respective intake strokes. Thus, the start of injection timings for cylinder numbers two and three are retarded from the start of injection timings for cylinder numbers one and four. By retarding injection timing it may be possible to improve fuel mixing and reduce fuel impingement on pistons. Further, the number of fuel injections supplied to cylinders two and three during cycles of the cylinders after time T4 is less than the number of fuel injections supplied to cylinders two and three during cycles of the cylinders after time T2 and before time T3.

In this way, a number of fuel injections and start of fuel injection timing for a first combustion event in a cylinder may be adjusted in response to a number of cylinder or engine cycles since a cylinder was deactivated. Further, the number of fuel injections and start of injection timing may be adjusted in response to a number of combustion events in the previously deactivated cylinders beginning from a time when the cylinders are reactivated.

Referring now to FIG. 4, a method for operating an engine is shown. The method of FIG. 4 may provide the operating sequence shown in FIG. 3. Additionally, the method of FIG. 4 may be included in the system of FIGS. 1 and 2 as executable instructions stored in non-transitory memory.

At 402, method 400 judges if engine load is less than a first threshold load (e.g., 304 of FIG. 3) at a present engine speed. The first threshold load may vary as engine speed varies. If method 400 judges that engine load is less than a first threshold load at 402, the answer is yes and method 400 proceeds to 403. Otherwise, the answer is no and method 400 proceeds to 408.

At 403, method 400 judges whether one or more engine cylinders are deactivated. Method 400 may judge that one or more cylinders are deactivated by assessing a state of a bit or word in memory or by determining a state of a sensing device. If method 400 judges that one or more cylinders are presently deactivated, the answer is yes and method 400 proceeds to 407. Otherwise, the answer is no and method 400 proceeds to 404.

At 404, method 400 resets counters for each cylinder that may be deactivated. Two counters may be provided for each cylinder that may be deactivated. A first counter for a cylinder may count a number of engine or cylinder cycles that an individual cylinder is deactivated (e.g., intake and exhaust valves are closed over at least an entire engine cycle (two revolutions for a four cycle engine), fuel flow is stopped to the cylinder, and spark is not provided to the cylinder) after the cylinder has been active (e.g., combusting air and fuel) for at least one cylinder cycle. A second counter for the cylinder may count a number of combustion events in the cylinder after the cylinder has been reactivated from a deactivated state. At 404, the first counters of each cylinder that may be deactivated are reset to a value of zero so that an accurate count of engine or cylinder cycles since the cylinder was deactivated may be determined. Method 400 proceeds to 406 after the first counter of each cylinder to be deactivated is reset to zero.

At 406, method 400 deactivates selected cylinders while the engine continues to rotate. The cylinders are deactivated by holding closed the intake and exhaust valves of the cylinders over at least an entire engine cycle (e.g., two engine crankshaft revolutions). Further, fuel flow and spark supplied to the cylinders being deactivated are ceased. The number of cylinders to be deactivated may depend on the total actual number of engine cylinders and the driver demand torque. In some examples, two cylinders may be deactivated for a four cylinder engine, three cylinders may be deactivated for a six cylinder engine, and four cylinders may be deactivated for an eight cylinder engine. FIGS. 2A-2C represent example cylinder deactivation arrangements. Method 400 proceeds to 407 after selected engine cylinders are deactivated.

At 407, method 400 increments count values of the first counters of cylinders that are deactivated. The first counters keep track of a number of cylinder cycles or engine cycles that occur while a cylinder is deactivated. Each time a deactivated cylinder completes a cycle, four piston strokes, or one engine cycle a count value held in the deactivated cylinder's first counter is incremented. Count values of other deactivated cylinders are incremented similarly. By counting the actual total number of engine cycles or cylinder cycles a cylinder is deactivated, it may be possible to determine a start of fuel injection time and a number of fuel injections to provide to the present deactivated cylinder. The number of engine or cylinder cycles since deactivating the cylinder may be useful in predicting temperatures in the cylinder when the cylinder is subsequently reactivated. For example, the number of cylinder events after the cylinder is deactivated may be indicative of piston temperature since when the cylinder was deactivated. Method 400 proceeds to 408 after first counters of deactivated cylinders have been updated.

At 408, method 400 judges if engine load is greater than a second threshold load (e.g., 302 of FIG. 3) at a present engine speed. The second threshold load may vary as engine speed varies. If method 400 judges that engine load is greater than a first threshold load at 408, the answer is yes and method 400 proceeds to 412. Otherwise, the answer is no and method 400 proceeds to 410.

At 410, method 400 continues to operate engine cylinders with a same number of fuel injections and start of fuel injection timing (SOI) as the engine cylinders presently are provided. For example, if engine cylinders have just been reactivated and fuel start of injection timing is retarded in the reactivated cylinders, the reactivated cylinders continue to be supplied fuel at a retarded start of fuel injection timing. Similarly, if newly reactivated cylinders receive two fuel injection pulses, the reactivated cylinders continue to receive two fuel injection pulses. Cylinders that have been active when other cylinders have been deactivated also continue to receive a same number of fuel injections and start of fuel injection timing as they received prior to reaching 410. Additionally, first counters of deactivated cylinders may continue to update as described at 407 for cylinders that are deactivated. However, SOI timing and an actual total number of fuel injections provided to an engine cylinder may continue to be adjusted based on an actual total number of combustion events in the cylinder. Fuel injection timing for all reactivated and active cylinders may be adjusted in this way. Method 400 proceeds to exit after fuel injection timings have been maintained.

At 412, method 400 judges if conditions are present to adjust injection timing of only reactivated engine cylinders. In one example, conditions may be present to adjust fuel injection timing only for reactivated cylinders based on engine temperature being less than a threshold temperature. In another example, conditions may be present to adjust fuel injection timing only for reactivated cylinders based on an actual total number of engine or cylinder cycles one or more engine cylinders have been deactivated. During some conditions it may be desirable to adjust fuel injection timing of only reactivated cylinders so that engine emissions and efficiency may be improved. However, during other conditions, it may be desirable to adjust fuel injection timing of all engine cylinders in response to activating deactivated engine cylinders. For example, it may be desirable to adjust fuel injection timing for all cylinders if engine temperature has been reduced to less than a threshold temperature so that particulate matter production by the engine may be further reduced. If method 400 judges that conditions are present to adjust fuel injection timing of only reactivated engine cylinders, the answer is yes and method 400 proceeds to 440. Otherwise, the answer is no and method 400 proceeds to 420.

At 420, method 400 reactivates selected engine cylinders. The engine cylinders are reactivated by allowing the intake and exhaust valves of the cylinders to open and close during cycles of the cylinders. Further, fuel injection for cylinders being reactivated for a first combustion event since being deactivated and fuel injection timing for cylinders that remained activated is adjusted to same timing.

In one example, fuel injection timing of newly reactivated cylinder or cylinders that are being reactivated is adjusted to a start of injection timing (SOI) that is retarded from start of injection timing in the cylinders that remained activated. For example, if (SOI) timing for cylinders that remained activated was the same for all cylinders that remained activated and the SOI fuel injection timing was 20 crankshaft degrees after top-dead-center intake stroke of the cylinder receiving the injected fuel, then SOI timing for cylinders that were deactivated may be retarded to 20 crankshaft degrees after bottom-dead-center intake stroke of the cylinder receiving injected fuel for a first combustion event since the cylinder receiving the fuel was reactivated.

In some examples, the SOI timing for cylinders that were deactivated is based on a number of engine cycles or cylinder cycles of the cylinder receiving the injected fuel was deactivated. For example, if the cylinder being reactivated was deactivated for two cylinder cycles, SOI timing may be 25 crankshaft degrees after top-dead-center intake stroke of the cylinder receiving the injected fuel. However, if the cylinder being reactivated was deactivated two hundred cylinder cycles, the SOI timing may be bottom-dead-center intake stroke of the cylinder receiving the fuel.

By adjusting SOI timing for cylinders being reactivated and active cylinder based on a number of cylinder cycles or engine cycles a cylinder was deactivated, it may be possible to adjust SOI timing to reduce particulate emissions more repeatable than if SOI were simply adjusted based on an amount of time a cylinder was deactivated. Adjusting SOI timing based on number of engine or cylinder cycles may be more reflective of cylinder contents (e.g. exhaust and air) than time because an actual total number of cylinder or engine cycles is invariant whereas a number of engine or cylinder cycles may vary for a fixed duration of time because of engine speed variations. Fuel injected to other engine cylinders being reactivated is supplied in a similar manner.

Additionally, SOI timing for cylinders that remained activated while selected cylinders were deactivated is adjusted to the same SOI timing as the cylinders being reactivated for a first combustion event since being deactivated. In this example, SOI injection timing of all cylinders that remained active while selected cylinders were deactivated is adjusted to 20 crankshaft degrees after bottom-dead-center intake stroke of the cylinder receiving the injected fuel.

In addition to adjusting SOI timing of cylinders that remained activated and cylinders being reactivated, an actual total number of fuel injections supplied to cylinders that remained activated and cylinders being reactivated may be adjusted. In one example, a number of fuel injections supplied to a cylinder receiving the injected fuel for a first combustion event in the cylinder receiving the fuel since the cylinder was reactivated from a deactivated state is based on an actual total number of engine cycles or cylinder cycles the cylinder receiving the fuel was deactivated. For example, if a cylinder was deactivated for two cylinder cycles, the cylinder may be supplied a total of one fuel pulse for a first combustion event in the cylinder receiving the fuel since the cylinder receiving the fuel was deactivated. However, if the same cylinder was deactivated for two hundred cylinder cycles, the cylinder may be supplied a total of two fuel pulses for a first combustion event in the cylinder receiving the fuel since the cylinder receiving the fuel was deactivated. Fuel injected to other engine cylinders being reactivated is supplied in a similar manner. The cylinders that remained activated are supplied a same number of fuel injections as the cylinders being reactivated. Method 400 proceeds to 422 after fuel injection timings for first combustion events in reactivated cylinders is determined and provided to engine cylinders.

At 422, method 400 increments counter values for cylinders. In particular as discussed at 404 each deactivated cylinder includes a first counter and a second counter. The second counter of a deactivated cylinder keeps track of a number of combustion events, intake events, exhaust events, or similar events for the cylinder that was deactivated after the cylinder is reactivated. The value in the cylinder's second counter is updated each time a combustion event or other specified event occurs after the cylinder is reactivated. Method 400 increments the values stored in the second counter of each deactivated cylinder that is reactivated in this way. Method 400 proceeds to 424 after cylinder counters are updated.

At 424, method 400 adjusts an actual total number of fuel injections delivered to each reactivated cylinder based on a value in each cylinder's second counter. For example, if a cylinder was reactivated with two fuel pulse for each cycle of the cylinder, the actual number of fuel pulses supplied to the cylinder during a cycle of the cylinder may be reduced to a value of one when the count value in the second counter of the cylinder receiving the fuel reaches a predetermined value (e.g., 200). Method 400 adjusts the actual total number of fuel injections based on an actual number of combustion events in the actual cylinder because a number of combustion events may provide improved cylinder status conditions as a basis for adjusting SOI and actual number of injections for reactivated cylinders. For example, a total number of combustion events may be a better indication of cylinder conditions than time based estimates of cylinder temperature and cylinder contents (e.g., air and exhaust gas) because discrete engine events may be directly related to engine conditions, whereas time based parameters may be more loosely related to engine conditions.

In this way, the actual number of fuel injections delivered to a cylinder that was reactivated may be adjusted based on the number of combustion events in the cylinder since it was reactivated. The actual number of fuel injections supplied to each deactivated cylinder during a cycle of the respective cylinder may be adjusted in this way. Further, in some examples, an actual number of fuel injections for cylinders that remained active while other cylinders were deactivated may be made the same as cylinders that were deactivated. The actual total number of fuel injections supplied to a reactivated cylinder may be greater than an actual total number of fuel injection supplied to an active cylinder when the reactivated was deactivated.

The actual total number of fuel injections delivered to a reactivated cylinder based on a number of combustion events in the reactivated cylinder may be empirically determined and stored in a table or function that is indexed by the value in the second counter of the cylinder receiving the fuel injection. The table outputs the actual total number of fuel injections and fuel is injected to the cylinder to conform to table output.

Method 400 also adjusts SOI timing for the reactivated cylinders based on combustion events in the reactivated cylinders since the cylinders were reactivated at 424. Specifically, SOI timing for a reactivated cylinder may be adjusted based on a number of combustion events or other events in the cylinder since the cylinder was reactivated. In one example, empirically determined SOI timing for a reactivated cylinder may be stored in a table or function that is indexed via a value in a second counter of the cylinder receiving the fuel. The value in the second counter corresponds to a number of combustion events or other events in the cylinder receiving the fuel since the cylinder receiving the fuel was reactivated. In one example, SOI timing for reactivated cylinder begins retarded from SOI timing of cylinders that were active while the reactivated cylinder was deactivated and SOI timing is advanced as the number in counter number two of the cylinder receiving the fuel increases. Additionally, in some examples, SOI timing of cylinders that were active when the reactivated cylinders were deactivated is adjusting to a same SOI timing as cylinders that were reactivated. Further, in some examples, the second counter may be omitted and cylinders being reactivated and cylinders that remained active while other cylinders where deactivated may be supplied fuel with an increased actual total number of fuel injections are retarded SOI timing as compared to operating at the same engine speed and load without having transitions from a cylinder deactivation mode to all cylinders operating within a predetermined amount of time (e.g., a time for the fuel injection timing to stabilize at a constant timing). Method 400 proceeds to 426 after SOI and the actual total number of injections provided to engine cylinders is adjusted.

At 426, method 400 judges whether or not values of counters of reactivated cylinders are greater than a predetermined value. In particular, the second counter of each reactivated cylinder is compared to the predetermined value. If a value of a second counter of a cylinder has not reached the predetermined value, the answer is no and method 400 returns to 422 so that the value in the second counter may continue to be incremented. Values of second counters for all reactivated cylinders are compared to the predetermined value. If the values of each second counter of each reactivated cylinder exceeds the threshold value, the answer is yes and method 400 proceeds to 428.

At 428, method 400 resets the value of each second counter for each reactivated cylinder to zero. Method 400 proceeds to 430 after the second counter values have been set to zero.

At 430, method operates all active engine cylinders with a same SOI timing and number of fuel injections per cylinder cycle. However, a fuel amount supplied to a particular cylinder may vary from fuel amounts supplied to other engine cylinders. Method 400 proceeds to exit after fuel injection is adjusted.

At 440, method 400 reactivates selected engine cylinders. The engine cylinders are reactivated by allowing the intake and exhaust valves of the cylinders to open and close during cycles of the cylinders. Further, fuel injection for cylinders that remained activated is not adjusted and is maintained at its present timing.

In one example, fuel injection timing of newly reactivated cylinder or cylinders that are being reactivated is adjusted to a start of injection timing (SOI) that is retarded from start of injection timing in the cylinders that remained activated. Specifically, if (SOI) timing for cylinders that remained activated was the same for all cylinders that remained activated and the SOI fuel injection timing was 20 crankshaft degrees after top-dead-center intake stroke of the cylinder receiving the injected fuel, then SOI timing for cylinders that were deactivated may be retarded to 20 crankshaft degrees after bottom-dead-center intake stroke of the cylinder receiving injected fuel for a first combustion event since the cylinder receiving the fuel was reactivated.

In some examples, the SOI timing for cylinders that were deactivated is based on a number of engine cycles or cylinder cycles of the cylinder receiving the injected fuel was deactivated. For example, if the cylinder being reactivated was deactivated for two cylinder cycles, SOI timing may be 25 crankshaft degrees after top-dead-center intake stroke of the cylinder receiving the injected fuel. However, if the cylinder being reactivated was deactivated two hundred cylinder cycles, the SOI timing may be bottom-dead-center intake stroke of the cylinder receiving the fuel.

By adjusting SOI timing for cylinders being reactivated and active cylinder based on a number of cylinder cycles or engine cycles a cylinder was deactivated, it may be possible to adjust SOI timing to reduce particulate emissions more repeatable than if SOI were simply adjusted based on an amount of time a cylinder was deactivated. Adjusting SOI timing based on number of engine or cylinder cycles may be more reflective of cylinder contents (e.g. exhaust and air) than time because an actual total number of cylinder or engine cycles is invariant whereas a number of engine or cylinder cycles may vary for a fixed duration of time because of engine speed variations. Fuel injected to other engine cylinders being reactivated is supplied in a similar manner.

In addition to adjusting SOI timing of cylinders being reactivated, an actual total number of fuel injections supplied to cylinders being reactivated may be adjusted. In one example, a number of fuel injections supplied to a cylinder receiving the injected fuel for a first combustion event in the cylinder receiving the fuel since the cylinder was reactivated from a deactivated state is based on an actual total number of engine cycles or cylinder cycles the cylinder receiving the fuel was deactivated. For example, if a cylinder was deactivated for two cylinder cycles, the cylinder may be supplied a total of one fuel pulse for a first combustion event in the cylinder receiving the fuel since the cylinder receiving the fuel was deactivated. However, if the same cylinder was deactivated for two hundred cylinder cycles, the cylinder may be supplied a total of two fuel pulses for a first combustion event in the cylinder receiving the fuel since the cylinder receiving the fuel was deactivated. Fuel injected to other engine cylinders being reactivated is supplied in a similar manner. An actual number of fuel injections supplied to cylinders that remained activated is not changed responsive to a number of combustion events since cylinders were reactivated. Method 400 proceeds to 442 after fuel injection timings for first combustion events in reactivated cylinders is determined and provided to engine cylinders.

At 442, method 400 increments counter values for cylinders. In particular as discussed at 404 each deactivated cylinder includes a first counter and a second counter. The second counter of a deactivated cylinder keeps track of a number of combustion events, intake events, exhaust events, or similar events for the cylinder that was deactivated after the cylinder is reactivated. The value in the cylinder's second counter is updated each time a combustion event or other specified event occurs after the cylinder is reactivated. Method 400 increments the values stored in the second counter of each deactivated cylinder that is reactivated in this way. Method 400 proceeds to 444 after cylinder counters are updated.

At 444, method 400 adjusts an actual total number of fuel injections delivered to each reactivated cylinder based on a value in each cylinder's second counter. For example, if a cylinder was reactivated with two fuel pulse for each cycle of the cylinder, the actual number of fuel pulses supplied to the cylinder during a cycle of the cylinder may be reduced to a value of one when the count value in the second counter of the cylinder receiving the fuel reaches a predetermined value (e.g., 200). Method 400 adjusts the actual total number of fuel injections based on an actual number of combustion events in the actual cylinder because a number of combustion events may provide improved cylinder status conditions as a basis for adjusting SOI and actual number of injections for reactivated cylinders. For example, a total number of combustion events may be a better indication of cylinder conditions than time based estimates of cylinder temperature and cylinder contents (e.g., air and exhaust gas) because discrete engine events may be directly related to engine conditions, whereas time based parameters may be more loosely related to engine conditions.

In this way, the actual number of fuel injections delivered to a cylinder that was reactivated may be adjusted based on the number of combustion events in the cylinder since it was reactivated. The actual number of fuel injections supplied to each deactivated cylinder during a cycle of the respective cylinder may be adjusted in this way. The actual total number of fuel injections supplied to a reactivated cylinder may be greater than an actual total number of fuel injection supplied to an active cylinder when the reactivated was deactivated.

The actual total number of fuel injections delivered to a reactivated cylinder based on a number of combustion events in the reactivated cylinder may be empirically determined and stored in a table or function that is indexed by the value in the second counter of the cylinder receiving the fuel injection. The table outputs the actual total number of fuel injections and fuel is injected to the cylinder to conform to table output.

Method 400 also adjusts SOI timing for the reactivated cylinders based on combustion events in the reactivated cylinders since the cylinders were reactivated at 424. Specifically, SOI timing for a reactivated cylinder may be adjusted based on a number of combustion events or other events in the cylinder since the cylinder was reactivated. In one example, empirically determined SOI timing for a reactivated cylinder may be stored in a table or function that is indexed via a value in a second counter of the cylinder receiving the fuel. The value in the second counter corresponds to a number of combustion events or other events in the cylinder receiving the fuel since the cylinder receiving the fuel was reactivated. In one example, SOI timing for reactivated cylinder begins retarded from SOI timing of cylinders that were active while the reactivated cylinder was deactivated and SOI timing is advanced as the number in counter number two of the cylinder receiving the fuel increases. Method 400 proceeds to 446 after SOI and the actual total number of injections provided to engine cylinders is adjusted.

At 446, method 400 judges whether or not values of counters of reactivated cylinders are greater than a predetermined value. In particular, the second counter of each reactivated cylinder is compared to the predetermined value. If a value of a second counter of a cylinder has not reached the predetermined value, the answer is no and method 400 returns to 442 so that the value in the second counter may continue to be incremented. Values of second counters for all reactivated cylinders are compared to the predetermined value. If the values of each second counter of each reactivated cylinder exceeds the threshold value, the answer is yes and method 400 proceeds to 448.

At 448, method 400 resets the value of each second counter for each reactivated cylinder to zero. Method 400 proceeds to 450 after the second counter values have been set to zero.

At 450, method operates all active engine cylinders with a same SOI timing and number of fuel injections per cylinder cycle. However, a fuel amount supplied to a particular cylinder may vary from fuel amounts supplied to other engine cylinders. Method 400 proceeds to exit after fuel injection is adjusted.

In this way, fuel injection for reactivated cylinders may be adjusted to control particulate emissions and improve fuel economy. Further, the method of FIG. 4 allows fuel injection of all cylinders to be adjusted to a same timing in response to activating deactivated engine cylinder. Alternatively, fuel injection for only reactivated cylinders may be adjusted to timings based on conditions of the reactivated cylinders.

Thus, the method of FIG. 4A-4D provides for a method, comprising: operating a first cylinder of an engine while a second cylinder of the engine is deactivated; reactivating the second cylinder in an engine cycle where the first cylinder is supplied a first actual total number of fuel injections; and supplying the second cylinder a second actual total number of fuel injections different than the first actual total number of fuel injections during the engine cycle. The method includes where the second cylinder is deactivated with closed cylinder valves, without fuel flowing to the cylinder, and without spark being supplied to the first cylinder. The method further comprises retarding start of fuel injection timing of the second cylinder to a timing that is more retarded than start of fuel injection timing for the first cylinder during the engine cycle.

In some examples, the method further comprises, for engine cycles subsequent to the engine cycle, adjusting start of fuel injection timing and the actual total number of fuel injections supplied to the second cylinder in response to an actual total number of combustion events in the second cylinder since the second cylinder was reactivated. The method further comprises reactivating a third cylinder during the engine cycle, and for engine cycles subsequent to the engine cycle, adjusting start of fuel injection timing and an actual total number of fuel injections supplied to the third cylinder in response to an actual total number of combustion events in the third cylinder since the third cylinder was reactivated. The method includes where a piston reciprocates in the second cylinder while the second cylinder is deactivated, and where the first cylinder is combusting varying amounts of air and fuel in response to a driver demand torque. The method includes where the second actual total number of fuel injections is based on a number of engine cycles the second cylinder was deactivated. The method includes where a start of fuel injection timing for the second cylinder during the engine cycle is based on a number of engine cycles the second cylinder was deactivated. The method includes where the second actual total number of fuel injections is greater than the first actual total number of fuel injections during the engine cycle.

The method of FIGS. 4A-4D also provides for a method, comprising: combusting air and fuel in a first cylinder of an engine with a first start of fuel injection timing while a second cylinder of the engine is deactivated; reactivating the second cylinder during an engine cycle and supplying fuel to the second cylinder at a second start of fuel injection timing retarded from the first start of fuel injection timing; and retarding fuel supplied to the first cylinder to the second start of fuel injection timing in response to reactivating the second cylinder. The method further comprises providing a first actual total number of fuel injections to the first cylinder when the second cylinder is deactivated, and supplying a second actual total number of fuel injections to the first cylinder in response to reactivating the second cylinder.

In some examples, the method includes where the second actual total number of fuel injections is further supplied to the second cylinder in response to reactivating the second cylinder. The method further comprises adjusting the second actual total number of fuel injections supplied to the first cylinder in response to a number of combustion events in the first cylinder since the second cylinder was reactivated. The method further comprises adjusting the second actual total number of fuel injections supplied to the second cylinder in response to a number of combustion events in the second cylinder since the second cylinder was reactivated.

The method of FIGS. 4A-4D also provides for a method for an engine comprising: selectively deactivating a cylinder of the engine based on engine load while continuing to rotate the engine; in response to a first reactivation of the cylinder, selectively adjusting fuel injection timing of the cylinder based on a number of combustion events in the cylinder since reactivating the cylinder while providing a different fuel injection timing to other respective cylinders of the engine; and in response to a second reactivation of the cylinder, adjusting fuel injection timing of all engine cylinders to a same timing. The method includes where the same timing is during compression strokes of the respective cylinders. The method includes where the cylinder is reactivated by supplying a number of fuel injections to the cylinder based on a number of engine cycles the cylinder was deactivated. The method includes where the cylinder is reactivated by supplying a start of fuel injection timing to the cylinder based on a number of engine cycles the cylinder was deactivated. The method further comprises reducing a number of fuel injections supplied to the cylinder after the cylinder is reactivated in response to a number of combustion events in the cylinder since the cylinder was reactivated. The method further comprises advancing start of fuel injection in the first cylinder after the cylinder is reactivated in response to a number of combustion events in the cylinder since the cylinder was reactivated.

Figure 5:
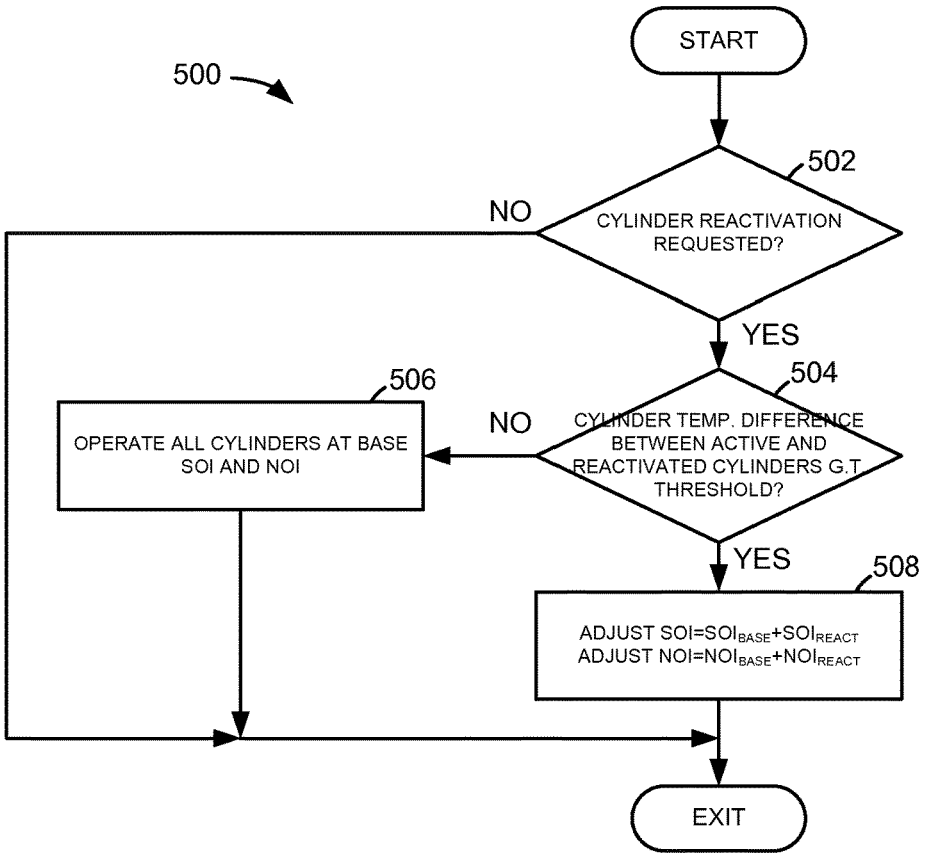
FIG. 5 shows another example method for operating an engine.

Referring now to FIG. 5, another method for reactivating deactivated engine cylinders is shown. The method of FIG. 5 may also be included in controller 12 as executable instructions stored in non-transitory memory.

At 502, method 500 judges if cylinder reactivation is requested. Cylinder reactivation may be requested in response to an engine load increase, engine temperature being less than a threshold temperature, catalyst temperature being less than a threshold temperature, or other operating conditions. If method 500 judges that cylinder reactivation is requested, the answer is yes and method 500 proceeds to 504. Otherwise, method 500 exits.

At 504, method 500 judges if a temperature difference between active cylinders or pistons (e.g., cylinders combusting air and fuel) and deactivated cylinders or pistons (e.g., cylinders not combusting) is greater than a threshold temperature. Cylinder and/or piston temperatures may be modeled based on operating conditions such as engine temperature, engine speed, engine load, and ambient air temperature. If method 500 judges that the temperature difference between active and deactivated cylinders is greater than a threshold, the answer is yes and method 500 proceeds to 508. Otherwise, the answer is no and method 500 proceeds to 506.

At 506, method 500 operates all engine cylinders with a same base start of injection timing and a same base number of fuel injections per cylinder cycle. The base start of injection timing and base number of fuel injections may be based on warm sustained operation of engine cylinders. Method 500 proceeds to exit after engine cylinders are operated with same base start of fuel injection and a same base number of fuel injections.

At 508, method 500 reactivates previously deactivated cylinders with a start of injection timing that is based on the temperature difference between active and deactivated cylinders. In one example, larger temperature differences retard start of injection timing closer to BDC intake stroke of the cylinder receiving the fuel. Smaller temperature differences retard start of injection timing closer to middle intake stroke of the cylinder receiving the fuel. Start of injection time for a reactivated cylinder may be expressed as:

$$SOI=SOI_{BASE}+SOI_{REACT}$$

where SOI is start of injection time, $SOI_{BASE}$ is start of injection base timing, and $SOI_{REACT}$ is a start if injection timing adjustment that is based on a temperature difference between active and deactivated cylinders.

Additionally, method 500 adjusts a number of fuel injections supplied to reactivated cylinders based on the temperature difference between active and deactivated cylinders. In one example, larger temperature differences increase the number of fuel injections per cylinder cycle of a cylinder receiving the fuel. Smaller temperature differences reduce the number of fuel injections per cylinder cycle of the cylinder receiving the fuel. Number of fuel injections for a reactivated cylinder may be expressed as:

$$NOI=NOI_{BASE}+NOI_{REACT}$$

where NOI is number of injections, $NOI_{BASE}$ is a number of injections for base timing (e.g., warm engine all cylinders operating for an extended time period), and $NOI_{REACT}$ is an actual number of injections adjustment that is based on a temperature difference between active and deactivated cylinders.

In this way, start of injection timing and an actual number of injections supplied to reactivated cylinders may be adjusted based on cylinder or piston temperature. Method 500 proceeds to exit after reactivated cylinder fuel timings are adjusted.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method, comprising:

operating a first cylinder of an engine while a second cylinder of the engine is deactivated;

reactivating the second cylinder in an engine cycle where the first cylinder is supplied a first actual total number of fuel injections; and supplying the second cylinder a second actual total number of fuel injections different than the first actual total number of fuel injections during the engine cycle.

2. The method of claim 1, where the second cylinder is deactivated with closed cylinder valves, without fuel flowing to the second cylinder, without spark being supplied to the second cylinder, and adjusting start of fuel injection timing and the second actual total number of fuel injections supplied to the second cylinder in response to piston or cylinder temperature.

3. The method of claim 1, further comprising retarding start of fuel injection timing of the second cylinder to a timing that is more retarded than start of fuel injection timing for the first cylinder during the engine cycle.

4. The method of claim 3, further comprising, for engine cycles subsequent to the engine cycle, adjusting start of fuel injection timing and the second actual total number of fuel injections supplied to the second cylinder in response to an actual total number of combustion events in the second cylinder since the second cylinder was reactivated.

5. The method of claim 4, further comprising reactivating a third cylinder during the engine cycle, and for engine cycles subsequent to the engine cycle, adjusting start of fuel injection timing and an actual total number of fuel injections supplied to the third cylinder in response to an actual total number of combustion events in the third cylinder since the third cylinder was reactivated.

6. The method of claim 1, where a piston reciprocates in the second cylinder while the second cylinder is deactivated, and where the first cylinder is combusting varying amounts of air and fuel in response to a driver demand torque.

7. The method of claim 1, where the second actual total number of fuel injections is based on a number of engine cycles the second cylinder was deactivated.

8. The method of claim 1, where a start of fuel injection timing for the second cylinder during the engine cycle is based on a number of engine cycles the second cylinder was deactivated.

9. The method of claim 1, where the second actual total number of fuel injections is greater than the first actual total number of fuel injections during the engine cycle.

10. The method of claim 1, further comprising retarding start of fuel injection timing of the second cylinder relative to the first cylinder during the engine cycle based on a temperature difference between the first and second cylinders.

11. The method of claim 10, wherein an amount that the start of injection timing of the second cylinder is retarded relative to the first cylinder increases for increases in the temperature difference.

12. The method of claim 1, wherein the second actual total number of fuel injections are direct fuel injections, injected into the second cylinder via a direct injection fuel injector.

13. A method, comprising:

combusting air and fuel in a first cylinder of an engine with a first start of fuel injection timing while a second cylinder of the engine is deactivated;

reactivating the second cylinder during an engine cycle and supplying fuel to the second cylinder at a second start of fuel injection timing retarded from the first start of fuel injection timing; and retarding timing of fuel supplied to the first cylinder to the second start of fuel injection timing in response to reactivating the second cylinder.

14. The method of claim 13, further comprising providing a first actual total number of fuel injections to the first cylinder when the second cylinder is deactivated, and supplying a second actual total number of fuel injections to the first cylinder in response to reactivating the second cylinder.

15. The method of claim 14, where the second actual total number of fuel injections is further supplied to the second cylinder in response to reactivating the second cylinder.

16. The method of claim 15, further comprising adjusting the second actual total number of fuel injections supplied to the first cylinder in response to a number of combustion events in the first cylinder since the second cylinder was reactivated.

17. The method of claim 16, further comprising adjusting the second actual total number of fuel injections supplied to the second cylinder in response to a number of combustion events in the second cylinder since the second cylinder was reactivated.

18. A method for an engine comprising:

selectively deactivating a cylinder of the engine based on engine load while continuing to rotate the engine;

in response to a first reactivation of the cylinder, selectively adjusting fuel injection timing of the cylinder based engine operating conditions while providing a different fuel injection timing to other respective cylinders of the engine, where during the first reactivation, the cylinder is reactivated by supplying a start of fuel injection timing to the cylinder based on a number of engine cycles the cylinder was deactivated; and in response to a second reactivation of the cylinder, adjusting fuel injection timing of all engine cylinders to a same timing.

19. The method of claim 18, where the same timing is during intake strokes of the respective cylinders, and where engine operating conditions include a temperature of a piston or the cylinder.

20. The method of claim 18, where during the first reactivation, the cylinder is reactivated by supplying an actual total number of fuel injections to the cylinder based on the number of engine cycles the cylinder was deactivated.

21. The method of claim 18, further comprising:

combusting air and fuel in a second cylinder of the engine with a first start of fuel injection timing while the cylinder is deactivated;

reactivating the cylinder during an engine cycle and supplying fuel to the cylinder at a second start of fuel injection timing retarded from the first start of fuel injection timing; and retarding timing of fuel supplied to the second cylinder to the second start of fuel injection timing in response to reactivating the cylinder.

22. The method of claim 21, further comprising:

reducing a number of fuel injections supplied to the cylinder after the cylinder is reactivated in response to a number of combustion events in the cylinder since the cylinder was reactivated;

incrementing a first counter for each cycle the cylinder is deactivated; and incrementing a second counter for each cycle the cylinder is activated after the cylinder is reactivated from a deactivated state.

23. The method of claim 22, further comprising advancing the start of fuel injection in the cylinder after the cylinder is reactivated in response to a number of combustion events in the cylinder since the cylinder was reactivated.

* * * * *